United States Patent [19]

Rasmussen

[11] 4,049,558

[45] Sept. 20, 1977

[54] FREE FLOWING PHOSPHATE ESTER COMPOSITIONS FOR POST ADDITION TO DETERGENTS

[75] Inventor: Hjorth Rasmussen, Copenhagen, Denmark

[73] Assignee: Colgate-Palmolive Company, New York, N.Y.

[21] Appl. No.: 679,304

[22] Filed: Apr. 22, 1976

Related U.S. Application Data

[63] Continuation of Ser. No. 378,882, July 13, 1973, abandoned.

[30] Foreign Application Priority Data

July 25, 1972 France ..... 72.26687

[51] Int. Cl.[2] ..... C11D 1/34; C11D 1/37; C11D 3/12; D06M 13/37

[52] U.S. Cl. ..... 252/8.9; 252/89 R; 252/109; 252/135; 252/539; 252/DIG. 17

[58] Field of Search ..... 252/8.9, 89, 135, 109, 252/539

[56] References Cited

U.S. PATENT DOCUMENTS

| | | | |
|---|---|---|---|
| 3,366,571 | 1/1968 | Cooper | 252/99 |
| 3,703,480 | 11/1972 | Grand | 252/524 |
| 3,738,943 | 6/1973 | Kaneko | 252/540 |
| 3,769,222 | 10/1973 | Yurko | 252/89 |

FOREIGN PATENT DOCUMENTS

| | | | |
|---|---|---|---|
| 1,300,829 | 12/1972 | United Kingdom | 252/89 |

OTHER PUBLICATIONS

"GAFAC Surfactants" Technical Bulletin 7543-094, published by General Aniline & Film Corp., 1960, 9 pages.

*Primary Examiner*—Dennis L. Albrecht

[57] ABSTRACT

Free-flowing, phosphate ester compositions for post addition to detergents are provided which comprise a homogeneous mixture of ethoxylated higher alkyl mono- and di- esters of phosphoric acid and including a mixture of mono- and di- lower alkyl esters of phosphoric acid in combination with finely divided silica having a surface area of over 10 square meters per gram. These compositions are useful additives for detergent compositions to give them a laundry softening capability.

4 Claims, No Drawings

FREE FLOWING PHOSPHATE ESTER COMPOSITIONS FOR POST ADDITION TO DETERGENTS

This is a continuation, of application Ser. No. 378,882 filed July 13, 1973 now abandoned.

This invention relates to the conversion of poorly flowing soft or pasty phosphate ester softening additives for particulate detergent compositions to particles which may be added to such compositions to give them a laundry softening capability without adversely affecting flowability of the detergent. More particularly, such conversion is effected by making a homogeneous aqueous mixture of the phosphate ester softener or a mixture of such softeners with finely divided silica and drying such mixture, usually at elevated temperature.

It has recently been discovered that phosphate esters and mixtures thereof, especially if ethoxylated, are useful additives for detergent compositions to impart softening properties to washed laundry or textiles. This has made it possible for detergents to be produced which do not require special addition of softening compositions in the rinse water nor applications of softener to the laundry in an automatic laundry dryer. Thus, by the use of these new compositions a much more convenient application of softener to the laundry may be effected. Other softening materials, such as cationic softeners, including the quaternary ammonium salts, e.g., distearyl dimethyl ammonium chloride, have been added to detergent compositions in substantial proportions so that some thereof will be deposited on the laundry in the wash cycle in the presence of the detergent, to obviate the need for addition of the softener in the rinse water. Yet, such materials tend to diminish the detergency of the composition and sometimes can cause a yellowing of the wash. On the contrary, the present phosphoric esters improve detergency, do not adversely affect forming abilities of the composition and do not spot, stain or discolor the wash.

Although possessed of many advantages for detergent composition use many phosphate ester softening additives are often soft or pasty, especially when in mixture or in acid form and this poor physical condition adversely affects the properties of detergent compositions containing them. For example, when spray dried the phosphate esters seem to migrate to the surfaces of the beads and cause them to be "lazy" or poorly flowing. On storage, there is some tendency toward tackiness and caking. Therefore, the spray drying of detergent compositions containing the phosphate ester softening additives has been avoided. While powdered compositions, usually very finely divided, have been fairly satisfactory, with the phosphate esters being distributed throughout the finely divided particles so as to minimize the effects of migration and make them flow better, nevertheless sometimes there can be a tendency to caking or lazy flow in granulated compositions, especially if they are stored for a lengthy period. The present invention overcomes this disadvantages and allows the production of desirably sized particulate detergent compositions containing the phosphate esters in such form that the detergents are attractive in appearance, freely flowing, not tacky and without objectionable tendencies to lump or cake in the box during storage.

In accordance with the present invention a free flowing particulate phosphate ester composition useful as an additive for particulate detergents to impart to them laundry softening properties comprises a homogeneous mixture of 0.1 to 4 parts of $R^1O(CH_2CH_2O)_mPO(OM)_2$ wherein $R^1$ is a higher alkyl of 14 to 20 carbon atoms, $m$ from 1 to 6 and M is an alkali metal or ammonium, 0.1 to 3 parts of $[R^1O(CH_2CH_2O)_m]_2POOM$, said mixture of phosphate esters having a melting point and/or softening point lower than 45° C. and from 0.1 to 5 parts of finely divided silica, with the amount of silica present being from 5 to 100% the total amount of the mentioned phosphate esters. For best flow results the silicas employed are amorphous, preferably pyrogenic silicas of high unit surface areas. Such compositions may be made by mixing the various components in an aqueous medium and drying it, during which procedure acidic phosphate esters may also be neutralized.

The active detersive and softening phosphoric esters are $R^1O(CH_2CH_2O)_mPO(OM)_2$, designated (I), wherein $R^1$ is a higher alkyl of 14 to 20 carbon atoms, $m$ is from 1 to 6 and M is an alkali metal or ammonium and $[R^1O(CH_2CH_2O)_m]_2POOM$ (II). Of these compounds it is considered that the diester is more effective as a softener and the monoester is a more powerful detergent. However, the combination appears to be especially useful and both products possess detersive and softening properties. Additionally, although essentially nonfoaming they do not interfere with the foaming of anionic detergents with which they may be formulated. In addition to the polyethoxylated esters mentioned, there will usually be present with these, alkyl phosphates of formulas $R^2OPO(OM)_2$ (III) and $(R^2O)_2POOM$ (IV). These help to disperse and solubilize the polyethoxy phosphoric esters and facilitate their manufacture and use. The useful softening detergent in which the fabric softening phosphoric esters are desirably formulated may contain from 0.1 to 5%, preferably 0.5 to 2% of I, 0.1 to 3% preferably 0.5 to 1.5% of II, 0.1 to 2%, preferably 0.2 to 1% of III and 0.1 to 1%, preferably 0.2 to 0.5% of IV. Preferred ratios of I:II and III:IV are 4.1 to 2:3, preferably 2:1 to 1:1, and 9:1 to 1:1, preferably 4:1 to 3:2 for the total of I and II to the total of III and IV. In these compounds $R^1$ is preferably higher alkyl of 16 to 18 carbon atoms, $m$ is preferably 1 to 2 to 4, M is preferably sodium and $R^2$ is preferred to be of about eight carbon atoms and most preferably is 2-ethylhexyl. Acid forms of the phosphoric esters, if employed, will normally be converted to sodium salts during the production of the ester-silica composition by neutralization with a base. Although $R^2$ is usually of about 8 carbon atoms, it may be alkyl of 6 to 10 carbons, preferably of 7 to 9.

The finely divided silica, which apparently functions to sorb the phosphate esters or otherwise to improve their flow properties, is an inert product with a high surface area per unit volume and correspondingly, is of small sorbent particles which may appear under the microscope to be porous. Usually, the very finely divided silicas will have surface areas of at least ten square meters per gram, preferably over 50 sq. m. per gram and sometimes as much as 500 or 1,000 sq. m. per gram. Particles sizes can range from as little as 0.001 micron to 50 microns but will preferably be in the 0.002 to 1 micron range and most preferrably 0.002 to 0.1 micron in diameter. Of course, particles of mixed sizes are utilized and the figures can be only averages.

Although some crysatlline silicas may be present, to obtain best sorption the silica should be amorphous. Colloidal silicas in the forms of aerogels and xerogels are useful but it is preferred to employ those which are characterized as fumed or pyrogenic silicas, such as the Cab-O-Sils, of which the types designated M-5 and H-5 are especially useful. Such will normally be of diameters in the range of 2 to 20 millimicrons. Descriptions of methods for the manufacture of such silicas are found in U.S. Pat. Nos. 2,886,414 and 3,391,997. Other useful silicas which may be interchanged with the Cab-O-Sil types, sometimes in partial replacement thereof, are those known as QUSO silicas, manufactured by Philadelphia Quartz Company, and Degussa silicas, such as those sold under identification silica K-322-S. Whatever the specific type of silica employed it is important that it be sorbent, of high volume/weight ratio and that it should be cooperative with the phosphoric ester mixture to sorb it, convert it to particulate form and make it free flowing. Usually, better results in these respects are obtained when the silicas are of particle sizes of 0.002 to 0.1 micron and of area to weight ratios of from 10 square meters per gram to 500 sq. m./g., with best results from using particles of diameters less than 0.02 micron and surface areas over 50 sq. m./g. However, it has been found that when silica is produced in situ, as from soluble silicators in an aqueous medium in which the phosphate esters are dispersed or dissolved, preferably in dissolved salt form, useful sorption of the esters is obtained despite the fact that the silica particles may be somewhat larger, sometimes being as much as 50 to 100 microns in diameter.

Although the individual silica particles may be micron or sub-micron sized they can and usually will be agglomerated or otherwise increased in particle size so as to form visible, dust-free particles, together with phosphoric ester, which may be blended with detergent composition particles to make usable softening laundry detergents in desired particulate form. When the free flowing particulate phosphate ester compositions are made by the preferred methods of this invention, by drying of an aqueous suspension of the mixed esters and silica (or silicate which is converted to silica) the particles will normally be in the 6 to 200 mesh range (3.36 mm. to 74 microns) preferably 6 to 170 mesh (3.36 mm. to 105 microns) and most preferably 8 to 140 mesh (2.38 mm. to 105 microns), U.S. Standard Sieve Series. If particles are outside this range, they may be screened or further agglomerated or reprocessed so that they become about the same size as the detergent composition particles with which they are to be blended. If necessary, oversize particles may be size-reduced and screened.

Although the only required materials in the particulate softening agent composition are the phosphoric esters and the silica, other detergent composition constituents may be present, if desired. However, except for colorants these will not normally be present because the more components in the softener the less freedom there is to formulate detergent compositions of different types since the ratios of the various ingredients present with the softener esters and silica would be fixed.

The proportion of silica to phosphoric ester mixture will normally be as low as possible to make a usefully flowing product. This will depend somewhat on the softening point of the phosphate ester mix but generally will be in the range of 5 to 100% of the content of esters I and II, normally somewhat more when esters III and IV are present. Thus, when the ester mix softening point is less than 45° C. and 0.1 to 4 parts I are present with 0.1 to 3 parts of II the silica content will be from 5 to 100% of the total of I and II. Similarly, when there are also present with I and II other esters III and IV of the types previously described to the extent of 0.1 to 2 parts and 0.1 to 1 part, respectively, the same range of silica contents is useful but to compensate for the additional esters the silica content may be desirably increased by from 10 to 50% (silica weight basis). A preferred proportion of silica, especially when it is fumed amorphous silica of sub-micron particle sizes, e.g., 0.001 to 0.1 micron, utilized with preferred softener compositions comprising 0.5 to 2 parts of I, 0.5 to 1.5 parts II, 0.2 to 1 part of III and 0.2 to 0.5 part of IV, is from 20 to 70%, most preferably 20 to 40% of the total phosphate ester softener content.

The various detergent compositions with which the flowable softening phosphoric esters may be blended include a wide variety of such products, encompassing virtually all the commercial detergents now on the market, which cause a hardening or stiffening to some extent of laundry washed with them. Thus, those based on anionic, nonionic or amphoteric synthetic organic detergents or soaps built with inorganic or organic builder salts may be blended with the free flowing softening particles of this invention. In such detergents the builder content will normally be from 20 to 70% and the active detersive ingredient will be from 5 to 40% with fillers, adjuvants and moisture also being present. Generally the proportion of filler, preferably sodium sulfate, will be from 5 to 50% while moisture will constitute from 2 to 15% and adjuvants from 1 to 10%, except for sodium perborate in bleaching detergents, which may be up to 30% of the detergent beads.

Preferred detergent compositions to be blended with the present softeners are those comprising from 2 to 20% of sodium linear higher ($C_{10-15}$) alkyl benzene sulfonate and 10 to 50% of a builder salt such as pentasodium tripolyphosphate, trisodium nitrilotriacetate, sodium citrate, sodium gluconate, disodium 2-hydroxyethyl iminodiacetate, sodium silicate, sodium carbonate, sodium bicarbonate or other suitable builder salt. In such compositions and with other detergents the proportion of ester composition to detergent composition will usually be in the 1:100 to 1:10 range, preferably 1:50 to 1:7. At such proportions, even if the ratio of silica employed is lower than dried to make prefectly free flowing softener beads the major proportion of freely flowing detergent particles surrounding the softener particles will prevent poor flow, lumping or tackiness in the ultimate product.

The method by which the present compositions are made is important in helping to obtain a desirable homogeneous distribution of the softening compounds and silica. Although it is posible to obtain improvement in flowability of the phosphoric esters by admixing them "dry" with finely divided silica, preferably in a high energy mixer or mixer-grinder such as a micropulverizer, with the softening compound in a liquid state, better penetration of the softener into the silica and greater improvements in flow characteristics result when the phosphoric esters are in solution (or suspension) in an aqueous or other liquid medium of comparatively low surface tension and are admixed with the finely divided silica, preferably in the form of a slurry, which is then dried and size reduced, if necessary. With the 0.1 to 4 parts of I, 0.1 to 3 parts of II and 0.1 to 5 parts finely divided silica, which is 5 to 100% of the total amount of the mentioned phosphate esters, there will usually be present from 0.1 to 100 parts of water. Such a range of moisture contents is also applicable when additional phosphoric esters III and IV are present to the extent of 0.1 to 2 parts and 0.1 to 1 part, respectively. Normally it will be preferable that the moisture content is at least 50 % of the solids content of the composition being mixed and less than 400% thereof. However, sufficient water should be present to form a workable slurry or solution and usually no more water will be employed than necessary to do this because most of it has to be removed in a drying operation.

In a preferred process, 2 to 10 parts of water and about 1 to 3 parts of phosphate ester mixture comprising 0.5 to 2 proportions of I, 0.5 to 1.5 proportions of II, 0.2 to 1 proportion of III and 0.2 to 0.5 proportion of IV, with silica present to the extent of 20 to 70% of the total amount of the mentioned phosphate esters, are mixed in conventional crutching or mixing equipment under vigorous agitation for a period of from 1 to 10 minutes after which it is dried at an elavated temperature. Shorter mixing times may be employed when special micropulverizing or homogenizing equipment is used. Normally, to promote solution, the mixture will be at a elevated temperature, e.g., 40° to 80° C., but this is not essential. After completion of mixing and production of a homogeneous slurry or solution-dispersion, the product may be dried with conventional equipment, such as a drum or tray dryer. Also useful are flash vaporizing dryers and spray dryers. The drying temperature is usually about 80° to 120° C., with drying gas or heat transfer surfaces being from 80° to 300° C. Drying is usually to 2 to 15% moisture content, preferably 3 to 10%. The product made may be screened to the desired particle size ranges previously mentioned or may be size reduced and screened. If too small, conventional agglomeration techniques may be employed to produce the final particles of desired size range distribution.

Instead of initially mixing the high surface area silica and the neutralized phosphoric esters, the acid forms of the esters may be employed and neutralization may be effected in the crutcher or other mixer by employment of the stoichiometric quantity of neutralizing agent. Of the neutralizing agents, sodium hydroxide in aqueous solution is preferred, usually as a 40 to 50% aqueous solution, but other neutralizing agents, such as sodium silicate, sodium carbonate, sodium bicarbonate, pentasodium tripolyphosphate, etc., or mixtures thereof may be employed instead, in aqueous solutions. Of course, the corresponding potassium and ammonium hydroxides and salts are useful too but it has been found that the sodium salts are freer flowing and therefore, sodium bases are preferred. Instead of a stoichiometic proportion, especially when pH adjustment in the final product is useful and when pH control may be employed to stabilize the phosphoric esters, an excess or deficiency of base may also be used, usually being ±20% of the stoichiometric proportion.

In place of the very finely divided amorphous silica as a starting material it has been found that a satisfactory free flowing product can be made when the silica is produced in situ. Thus, aqueous sodium silicate solution ($Na_2O:SiO_2$ 32 2:1 to 1:3) is mixed with a dispersion of the phosphate ester softeners, in acid forms, in water and the mixture is dried at an elevated temperature, e.g., 60° to 95° C. During the drying, the silicate is converted to silica and the phosphoric esters are neutralized. Care is taken during the mixing operation to maintain especially vigorous mixing to prevent production of large crystals. For the same reason the drying preferred is film drying with film thicknesses of 0.001 to 0.1 cm. Proportions of the various reagents which are desirably employed include from 0.5 to 2 parts of the preferred mixture of phosphoric esters, in acid form, dispersed in from 50 to 200% of the weight thereof of water and admixed with 30 to 90% of the total phosphate ester weight of sodium silicate of a preferred $Na_2O:SiO_2$ ratio of 1:1.5 to 1:2.4, which is in 50 to 500% of its weight of water. Drying temperatures and conditions are the same as those previously described but thin film drying is even more preferable for the in situ method than for that mentioned earlier.

The products made, whether by the addition of silica or in situ generation, improve the flowability of the phosphoric esters. Additionally, the manufacturing technique allows for simultaneous neutralization of the acid forms of such esters; in which they are normally available. Berol TVM-729, manufactured by Berol Aktiebolaget (Sweden) is a useful mixture of such acid forms of the various phosphoric ester softeners.

The flowable softener particles made, especially if produced from Degussa K-322-S or Cab-O-Sil M-5 or H-5 types of finely divided amorphous silicas, are much improved with respect to flowability, being almost like that of the balance of the detergent composition with which they may be incorporated. The particles of softener in such compositions do not exhibit objectionable migration of the softener to the beads' surfaces, do not lump excessively, are not tacky and do not inhibit flow of the detergent. Additionally, the silicas wash out easily from the rinse water and do not deposit on articles or textiles being laundered nor do they interfere with the desirable softening and antistatic properties of the phosphoric ester mixtures.

The following examples illustrate but do not limit the invention. Unless otherwise indicated, all parts are by weight and all temperatures are in ° C.

EXAMPLE 1

| | Kilograms |
|---|---|
| *$R^1O(CH_2CH_2O)_2PO(ONa)_2$ | 78 |
| *$[R^1O(CH_2CH_2O)_2]_2POONa$ | 60 |
| **$R^2OPO(ONa)_2$ | 35 |
| **$(R^2O)_2POONa$ | 22 |
| Amorphous silica (pyrogenic Cab-O-Sil M-5, of particle sizes of 2–20 millimicrons and about 100–200 sq. m./g.) | 80 |
| Water | 225 |

*$R^1$ = mixed higher alkyls of 16 to 18 carbon atoms (65% $C_{16}$ and 35% $C_{18}$)
**$R^2$ = 2-ethyl-n-hexyl The phosphoric ester softeners mixture is dissolved in the water at a temperature of 50° C, after which the silica is added over a period of about two minutes with vigorous stirring. While maintaining stirring, the composition is fed to trays on which it is deposited in thin layers so that the films produced on drying are about 0.05 cm. thick. The trays are placed in an oven in which the air temperature is 105° C. and when the mix is dried, are removed therefrom. After cooling to 20° C., the films are removed from the trays, size reduced and screened so as to be of particle sizes in the 8 to 100 mesh range. They are blended with particles of several commercial detergents of similar particle size range in a ratio of one part of the phosphoric ester-silica to 20 parts of the detergent (the detergent is essentially of 10 parts sodium linear dodecyl benzene sulfonate, 20 parts pentasodium tripolyphosphate, 20 parts sodium silicate ($Na_2O:SiO_2$ = 1:2.4), 10 parts water, five parts adjuvants and the balance sodium sulfate). When products with and without the softening composition are utilized to wash cotton towels a noticeable improvement in softening with such compositions present is detectable by consumers.

In variations of the above experiment, when the Cab-O-Sil M-5 is replaced by Degussa silica K-322-S essentially the same results are obtained. In both cases flowability of the final detergent product is improved, compared to similar products in which the softening phosphoric esters are spray dried from a crutcher mix with the rest of the detergent components. Also, improvements are noted in resistance to lumping and tackiness after lengthy storage of the product.

A variation of the above experiment is conducted wherein 50 parts of water are replaced with 70 parts of 46% aqueous sodium hydroxide and the phosphoric esters are employed in their acidic forms in 70:53:31:21 relative proportions. In this procedure the phosphoric acids are dispersed in water and are neutralized by addition of the sodium hydroxide solution over a period of about ten minutes, with good agitation, after which the silica is added, following the procedure previously described. Essentially no differences are noted in the end products, the free flowing ester compositions and the detergents to which they are added, whether the Cab-O-Sil or Degussa silica is used and whether or not neutralization is effected in the mixing of the esters and the silica. Similarly, in the runs described useful products of essentially the same properties are obtainable when drying is by drum drying, flash vaporization drying, tray drying or spray drying. Final analyses of all such products, on an anhydrous basis, is 71.2% of the phosphoric esters and 28.8% of a finely divided silica. For commercial products drying is halted at about the 5% moisture level so as to avoid mass transfer of moisture between the particles, which can promote caking thereof in the boxed detergent.

EXAMPLE 2

The neutralization and mixing procedures of Example 1 are repeated, using a laboratory mixer to produce ten kilograms of slurry of the following formula for drying. However, in this case the sodium hydroxide is added initially to the water, followed by the phosphoric ester acids (Berol TVM-729)

| | Kilograms |
|---|---|
| NaOH (46% aqueous) | 0.65 |
| Berol TVM-729 | 1.62 |
| Water | 7.0 |
| Silica K-322-S (finely divided, amorphous) | 0.73 |

After making of the neutralized slurry, using water at room temperature, it is dried on a drum dryer to a moisture content of 8%, using low pressure steam to heat the surface of the drum dryer to 90° C. The product is then cooled and pressed through a 40 mesh screen to produce the desired particle sizes. It is a free flowing composition suitable for addition to heavy duty built synthetic organic detergents to improve the softening powers thereof without diminishing flow properties. Similar effects are obtained when Cab-O-Sil H-5 or a QUSO silica of similar particle sizes and porosity is substituted for the Degussa silica.

EXAMPLE 3

Utilizing pilot plant equipment, including a Janke-Kunkel turbine homogenizer, five kilograms of phosphoric ester-silica slurry are prepared from 1.13 kg. of mixed phosphoric acid esters of Example 1, in acid form and 1.48 kg. of sodium silicate solution ($Na_2O:SiO_2$ = 1:2), as a 44% solution in water, after preliminary mixing of these materials with 1.2 and 1.3 kg. water, respectively. Mixing is at room temperature and neutralization and silica production occur over a period of about ten minutes, during which vigorous agitation is maintained continuously. The slurry produced is dried in a pilot plant drum dryer and some is sprayed in a pilot plant spray dryer. After cooling, the products are screened to desirable 40 mesh size and are found to be free flowing, non-tacky and suitable for incorporation in detergents. Analysis of the products shows that is contains 75% of the neutralized sodium phosphoric ester softener salts, in mixture, and 25% of silica. No hard granules of precipitated silica are noted in the product and when employed with a detergent composition to wash textiles in an automatic washing machine, no objectionable deposition of silica on the materials washed results.

In modifications of this experiment other silicates of different $Na_2O:SiO_2$ ratios (1:1.8; 1:2.8) are employed in stoichiometric proportions to neutralize the phosphoric ester acids and produce the silica sorbent. No problems are encountered in preventing formation of large crystals and the product is of essentially the same characteristics as that made from the 1:2 material. Also, when products of this example are mixed in equal proportions with those of Example 2 and added to a heavy duty built detergent good softening and flow properties result in the product.

The invention has been described with respect to various illustrations and examples thereof but is not to be limited to them because it will be evident to one of skill in the art how modifications may be made, equivalents employed and substitutes utilized without departing from the spirit or scope of the invention.

What is claimed is:

1. A free flowing particulate phosphate ester composition useful as an additive for particulate detergents to impart to them laundry softening properties which comprises a homogeneous mixture of 0.1 to 4 parts of $R^1O(CH_2CH_2O)_mPO(OM)_2$ wherein $R^1$ is a higher alkyl of 14 to 20 carbon atoms, m is from 1 to 6 and M is an alkali metal or ammonium, 0.1 to 3 parts of $[R^1O(CH_2CH_2O)_m]_2$-POOM, 0.1 to 2 parts of $R^2OPO(OM)_2$ wherein $R^2$ is alkyl of 6 to 10 carbon atoms and 0.1 to 1 part of $(R^2O)_2POOM$, said mixture of phosphate esters having a melting point and/or softening point lower than 45° C. and from 0.1 to 5 parts of finely divided silica, having a surface area of oven ten square meters per gram with the amount of silica present being from 5 to 100% the total amount of the mentioned phosphate esters.

2. A phosphate ester composition according to claim 1, wherein the proportions of $R^1O(CH_2CH_2O)_m$-$PO(OM)_2$ to $[R^1O(CH_2CH_2O)_m]_2$ POOM and of $R^2OPO(OM)_2$ to $(R^2O)_2$-POOM are from 4:1 to 2:3 and the proportion of the total of $R^1O(CH_2CH_2O)_m$-$PO(OM)_2$ and $[R^1O(CH_2CH_2O)_m]_2$—POOM to the total of $R^2OPO(OM)_2$ and $(R^2O)_2POOM$ are from 0:1 to 1:1, and the silica is of an average particle size less than 0.02 micron and has a surface area greater than 50 sq. meters per gram.

3. A phosphate ester composition according to claim 2 which comprises a homogeneous mixture of 0.5 to 2 parts of $R^1O(CH_2CH_2O)_mPO(OM)_2$, 0.5 to 1.5 parts of $[R^1O(CH_2CH_2O)_m]_2POOM$, 0.2 to 1 part of $R^2OPO(OM)_2$ and 0.2 to 0.5 part of $(R^2O)_2POOM$, $R^1$ is higher alkyl of 16 to 18 carbon atoms, *m* is 1 to 4, M is sodium and $R^2$ is of 7 to 9 carbon atoms, and the silica is a fumed amorphous silica and is present to the extent of 20 to 70% of the total amount of the mentioned phosphate esters.

4. A free flowing particulate detergent composition comprising 5–40% synthetic organic detergent and 20–70% builder salt therefor in substantially homogeneous particulate form and a phosphate ester composition of claim 1 distributed evenly through the detergent particles, with the particle sizes of the phosphate ester composition and the detergent composition being within the range of 6 to 200 mesh and the proportion of such compositions being from 1:100 to 1:10 ester composition; detergent composition, said synthetic organic detergent being selected from the group consisting of anionic sulfonates, nonionic, amphoteric synthetic organic detergents and soaps.

* * * * *

UNITED STATES PATENT AND TRADEMARK OFFICE

CERTIFICATE OF CORRECTION

PATENT NO. : 4,049,558

DATED : September 20, 1977

INVENTOR(S) : Hjorth Rasmussen

It is certified that error appears in the above-identified patent and that said Letters Patent are hereby corrected as shown below:

Column 1, line 38. change "forming" to --foaming--

Column 2, line 42. change "1 to 2 to 4" to --1 or 2 to 4--

Column 2, line 62. change "preferrably" to --preferably--

Column 4, line 52. change "posible" to --possible--

Column 5, line 61. change "($Na_2O$: $SiO_2$ 32 2:1 to 1:3)" to --($Na_2O$: $SiO_2$ = 2:1 to 1:3)--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*